US006863375B2

(12) United States Patent
Makigaki et al.

(10) Patent No.: US 6,863,375 B2
(45) Date of Patent: Mar. 8, 2005

(54) EJECTION DEVICE AND INKJET HEAD WITH SILICON NOZZLE PLATE

(75) Inventors: Tomohiro Makigaki, Suwa (JP); Taro Takekoshi, Suwa (JP); Masahiro Fujii, Suwa (JP); Koji Kitahara, Suwa (JP); Seiichi Fujita, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 119 days.

(21) Appl. No.: 10/026,315

(22) Filed: Dec. 20, 2001

(65) Prior Publication Data

US 2002/0056698 A1 May 16, 2002

Related U.S. Application Data

(62) Division of application No. 09/423,788, filed on Jan. 5, 2000, now Pat. No. 6,375,858.

(30) Foreign Application Priority Data

May 14, 1997 (JP) ..... 9-124573
Jan. 16, 1998 (JP) ..... 10-6687
Feb. 2, 1998 (JP) ..... 10-20550

(51) Int. Cl.[7] ..... B41J 2/14
(52) U.S. Cl. ..... 347/47
(58) Field of Search ..... 347/47, 50; 222/575; 239/601

(56) References Cited

U.S. PATENT DOCUMENTS 3,921,916 A * 11/1975 Bassous ..... 239/601
4,047,186 A * 9/1977 Kendall et al. ..... 347/47
4,209,794 A * 6/1980 Kattner ..... 347/47
4,733,823 A 3/1988 Waggener et al. ..... 239/601
4,828,184 A * 5/1989 Gardner et al. ..... 239/590.3
5,157,418 A * 10/1992 Tamura ..... 347/58
5,389,957 A * 2/1995 Kimura et al. ..... 347/20
5,491,499 A * 2/1996 Bibbe et al. ..... 347/47
5,513,431 A 5/1996 Ohno et al. ..... 29/890.1
5,519,421 A * 5/1996 Barr et al. ..... 347/47
5,534,900 A 7/1996 Ohno et al. ..... 347/54
5,912,684 A 6/1999 Fujii et al. ..... 347/54
6,454,393 B2 * 9/2002 Chen et al. ..... 347/47

FOREIGN PATENT DOCUMENTS

EP 0 178 596 4/1986
EP 0 435 576 A1 7/1991
EP 0 465 229 A1 1/1992
EP 0 479 441 4/1992
EP 498 291 A1 * 8/1992 ..... B41J/2/05
EP 0 750 992 1/1997
EP 0 761 447 A2 3/1997
JP 56-135075 10/1981
JP 61-98558 5/1986
JP 4-125159 4/1992
JP 5-50601 3/1993
JP 9-11479 1/1997
JP 9-300630 11/1997

* cited by examiner

*Primary Examiner*—Lamson Nguyen
*Assistant Examiner*—Blaise Mouttet
(74) *Attorney, Agent, or Firm*—Mark P. Watson

(57) ABSTRACT

A silicon nozzle plate includes nozzles each with a first nozzle portion having a circular cross-section and a second nozzle portion having a circular cross-section wherein the circular cross-section of the first nozzle portion is smaller than the circular cross-section of the second nozzle portion. In one embodiment the nozzle plate is utilized in an inkjet head and includes a recess having a flat bottom surface that commonly communicates with a plurality of first nozzle portions and a through hole that exposes terminal portions that supply control signals to pressure generators.

5 Claims, 10 Drawing Sheets

Fig. 3(A) Step1

Fig. 3(B) Step2

Fig. 3(C) Step3

Fig. 4(A) Step4

•ICP processing•

Fig. 4(C) Step5

•ICP processing•

Fig. 5(A) Step6

Fig. 5(B) Step7

Fig. 5(C) Step8

Fig. 7(A) Step1

Fig. 7(B) Step2

Fig. 7(C) Step3

Fig. 8(A) Step4

•ICP processing•

Fig. 8(C) Step5

•ICP processing•

Fig. 9(A) Step6

Fig. 9(B) Step7

Fig. 9(C) Step8

EJECTION DEVICE AND INKJET HEAD WITH SILICON NOZZLE PLATE

CONTINUING APPLICATION DATA

This application is a divisional of Ser. No. 09/423,788 filed Jan. 5, 2000, now U.S. Pat. No. 6,375,958 which is a 371 of PCT/JP98/02108 filed May 13, 1998 the contents of which are incorporated herein by reference in their entirety.

TECHNICAL FIELD

The present invention relates to a method of forming a nozzle for an ejection device for ejecting or spraying a liquid or a gas. More particularly, the present invention relates to a method of forming a nozzle having a cross-section which is made smaller stepwise toward the front end thereof by etching a silicon monocrystalline substrate. Further more, the present invention relates to a method of forming a nozzle plate which is preferable for an inkjet head for ejecting ink droplets.

BACKGROUND ART

For example, the inkjet head of an inkjet printer generally comprises a plurality of nozzles for ejecting ink droplets therefrom and an ink supply passage communicating with the nozzles.

Recently, it has become necessary to more precisely and more minutely process inkjet heads to permit ultrafine characters to be printed. For this purpose, there have been proposed many methods of forming micropore nozzles by applying anisotropic-etching to a silicon substrate.

It is preferable to use a nozzle having such a cross-sectional shape that a thin nozzle hole portion is formed on the front end side thereof and a nozzle hole portion expanding in a conical shape or a pyramidal shape is formed at the rear end side thereof in order to improve the ink ejection characteristics of the respective nozzles of an inkjet head. For example, as disclosed in Japanese Unexamined Patent Publication No. 56-135075, when a nozzle is formed in a cylindrical shape at the front end side thereof and the inner periphery of the nozzle is formed in a truncated-quadrangular-prism shape at the rear side thereof, the directions of ink pressures imposed on nozzles from an ink cavity side can be aligned in the axial directions of the nozzles, as compared with a case where cylindrical nozzles are used. Stable ink ejection characteristics can be obtained thereby. That is, since variations in the trajectories of ink droplets can be eliminated, they are prevented from flying in differing directions, whereby variations in the amount of the ink droplets can be suppressed.

As disclosed in Japanese Unexamined Patent Publication No. 56-135075, however, since the truncated-quadrangular-prism-shaped inner periphery of the nozzle on the rear side is formed in a silicon substrate using anisotropic-etching, the inner periphery is formed along the crystal direction of the silicon. Thus, the angle of the inclined rear portion of the nozzle is reduced to obtain an action for aligning the directions of ink pressures imposed on the nozzles from the ink cavity side in the axial directions of the nozzles. That is, it is impossible to decrease the cross-sectional area of the nozzle on the rear side thereof.

In contrast, for example, Japanese Unexamined Patent Publication No. 5-50601, filed by the applicants, discloses a method of manufacturing an electrostatic drive type inkjet head in which a nozzle and an ink supply passage are formed with pinpoint accuracy by applying photolithography and wet-type-crystal-anisotropic-etching to a silicon monocrystalline substrate.

The inkjet head disclosed in the publication employs a structure in which nozzles, reservoirs, ink supply passages such as cavities and the like, and diaphragms are formed on a silicon monocrystalline substrate bonded to a glass electrode substrate, on which electrodes for deflecting the diaphragms by electrostatic force are formed.

The use of this structure allows a manufacturing method to be employed in which after the patterns (nozzles, ink supply passages, electrodes) of respective inkjet heads are formed on the respective substrates, the substrates are bonded to each other and the thus-bonded substrates are cut and separated into the respective inkjet heads (the so-called method of making multiple inkjet heads from a single substrate), whereby the inkjet heads can be manufactured at low cost. Note that an example of the method of making multiple inkjet heads from a single substrate is disclosed in Japanese Unexamined Patent Publication No. 9-300630, filed by the applicants. Specifically, the publication proposes a method of bonding a plurality of cover substrates and a flow passage substrate in a row state so that terminals formed at a lower substrate to supply a signal or power are exposed.

Incidentally, when nozzles are formed on a cover substrate for covering an ink supply passage and the cover substrate itself is used as a nozzle plate, it is preferable for accuracy that after a single nozzle plate is bonded to a flow passage substrate, the combined substrate be separated to respective inkjet heads, as compared with the method disclosed in Japanese Unexamined Patent Publication No. 9-300630.

In this case, a through-hole for exposing terminals formed on the lower substrate must be formed, in addition to the nozzles, on the nozzle plate as the uppermost substrate of these three substrates.

Etching is carried out at a relatively low rate in a process for forming nozzle holes because pinpoint processing accuracy is required in the process. In contrast, etching is carried out at a relatively high rate in a process for forming the through-hole whose accuracy is relatively not as stringent as that for the nozzle holes because a reduction in etching time takes precedence over processing accuracy. As a result, the process for forming the nozzle holes and the process for forming the through-hole, the etching conditions of which are different from each other, have ordinarily been performed independently from each other. That is, after the through-hole is formed by etching, the nozzle holes are etched; or after the nozzle holes are formed by etching, the through-hole etched.

Thus, all the sub-processes relating to the etching process, such as patterning including the formation of a resist film, masking, and the removal of the resist film, rinsing, and the like, must be carried out twice, whereby problems arise in that the manufacturing process is complex and the manufacture is time-consuming.

Problems to be solved by the present invention, which was made in view of the above points, primarily reside in the following two points:

1) to propose a method for forming a nozzle for an ejection device in a monocrystalline silicon substrate, the nozzle having a substantial action for aligning the directions of pressures imposed on nozzles from a cavity side in the axial directions of the nozzles, as compared with the action obtained by a conventional method; and 2) to propose a method for manufacturing an inkjet head capable of forming a nozzle without lowering the processing accuracy thereof, as well as capable of forming a through-hole, which is very large relative to the nozzle, on a monocrystalline silicon substrate simultaneously with the formation of the nozzle, thereby simplifying the manufacturing process and reducing manufacturing time.

DISCLOSURE OF THE INVENTION

To solve the problem 1), the present invention employs a dry-etching method by ICP (induction coupled plasma) discharge as an anisotropic dry-etching method to form a nozzle having a cross-section made smaller stepwise toward the front end thereof by applying etching to a silicon monocrystalline substrate.

That is, in a method of forming a nozzle of the present invention, first, an oxidized silicon film, for example, is formed as a resist film on a surface of the silicon monocrystalline substrate. Next, a first opening pattern is formed by removing the resist film at a portion corresponding to the rear end of the nozzle and a second opening pattern which is smaller than the first pattern is formed by removing the resist film at a portion corresponding to the front end of the nozzle. Next, dry-etching is applied by plasma discharge to the exposed portions of the surface of the silicon monocrystalline substrate exposed by the first and second opening patterns. At this time, a gas for etching silicon by conversion to a plasma by plasma discharge and a gas for suppressing the etching of silicon by conversion to a plasma by plasma discharge are alternately charged into a processing vessel in which the silicon substrate is disposed. With this processing, a nozzle is formed having a cross-section which coincides with the shapes of the respective opening patterns and is made smaller stepwise from the rear end thereof toward the front end thereof.

Furthermore, when the respective opening patterns are formed as described below, a nozzle whose cross-section is made smaller stepwise from the rear end thereof toward the front end thereof can be formed by performing dry-etching only from one side of the silicon substrate, whereby the manufacturing process can be further simplified.

That is, after a resist film is formed on a surface of the silicon monocrystalline substrate, the opening pattern, which corresponds to the portion of the nozzle at the rear end thereof, is formed at the resist film by half-etching the resist film (first patterning process). Next, an opening pattern which corresponds to the portion of the nozzle at the front end thereof is formed as the exposed portion of the surface of the silicon monocrystalline substrate by full-etching a portion of the half-etched region of the resist film at which the above opening pattern is formed (second patterning process). Thereafter, a first groove having a predetermined depth is formed by applying dry-etching to the exposed portion of the silicon monocrystalline substrate by plasma discharge (first dry-etching process). Then, after the surface of the silicon monocrystalline substrate is exposed by full-etching the half-etched region of the resist film, a second groove having a predetermined depth, while the first groove remains on the bottom thereof, is formed by applying dry-etching to the silicon monocrystalline substrate by plasma discharge (second dry-etching process).

When anisotropic-dry-etching is started by plasma discharge in the first dry-etching process, only the surface portion of the silicon monocrystalline substrate whose surface is exposed by the full-etching is vertically removed by the etching so that the first groove having a predetermined depth is formed. In the second dry-etching process, the etching of the surface of the silicon monocrystalline substrate is conducted in a state in which the first groove which was formed first by the etching remains as it is, and the second groove is formed. When etching conditions are properly determined, the depth of the portion of the first groove can be set to a size which coincides with the nozzle at the front end thereof having a small cross-section and the depth of the portion of the second groove can be set to a size which coincides with the nozzle at the rear end thereof having a large cross-section.

According to the method, a master pattern need not be repeatedly formed on the surface of the silicon monocrystalline substrate. Further more, a master pattern need not be formed along the surface of the silicon monocrystalline substrate in the stepwise state after a recess is formed at the silicon monocrystalline substrate. Thus, according to the nozzle forming method of the present invention, the nozzle having the stepwise-cross-section can be effectively and simply formed.

To solve the problem 2), the present invention employs a method arranged such that a first fine groove acting as the nozzle is formed up to a predetermined depth and a second groove acting as a part of a through-hole, which exposes a terminal disposed on a substrate to be bonded to the lower side of a substrate serving as a nozzle plate, are formed from a surface of the substrate serving as the nozzle plate by etching. Thereafter, a third groove, larger than the first groove, is formed from the other surface of the upper substrate by etching, and the nozzle and the through-hole are simultaneously formed by penetrating the first groove and the second groove.

With this procedure, the through-hole can be formed simultaneously with the nozzle without lowering processing accuracy. When the through-hole is relatively large, it is preferable to form the second groove by etching into a shape which follows the contour of the outer periphery of the through-hole. Since the etching area of the portion of the through-hole can be reduced thereby, the reduction of etching speed can be prevented, and the deterioration of the accuracy of the grooves in a depth direction caused by the etching applied to a wafer surface can be prevented.

BEST MODE FOR CARRYING OUT THE INVENTION

Example of an Inkjet Head to Which the Present Invention is Applied

Figure 1:
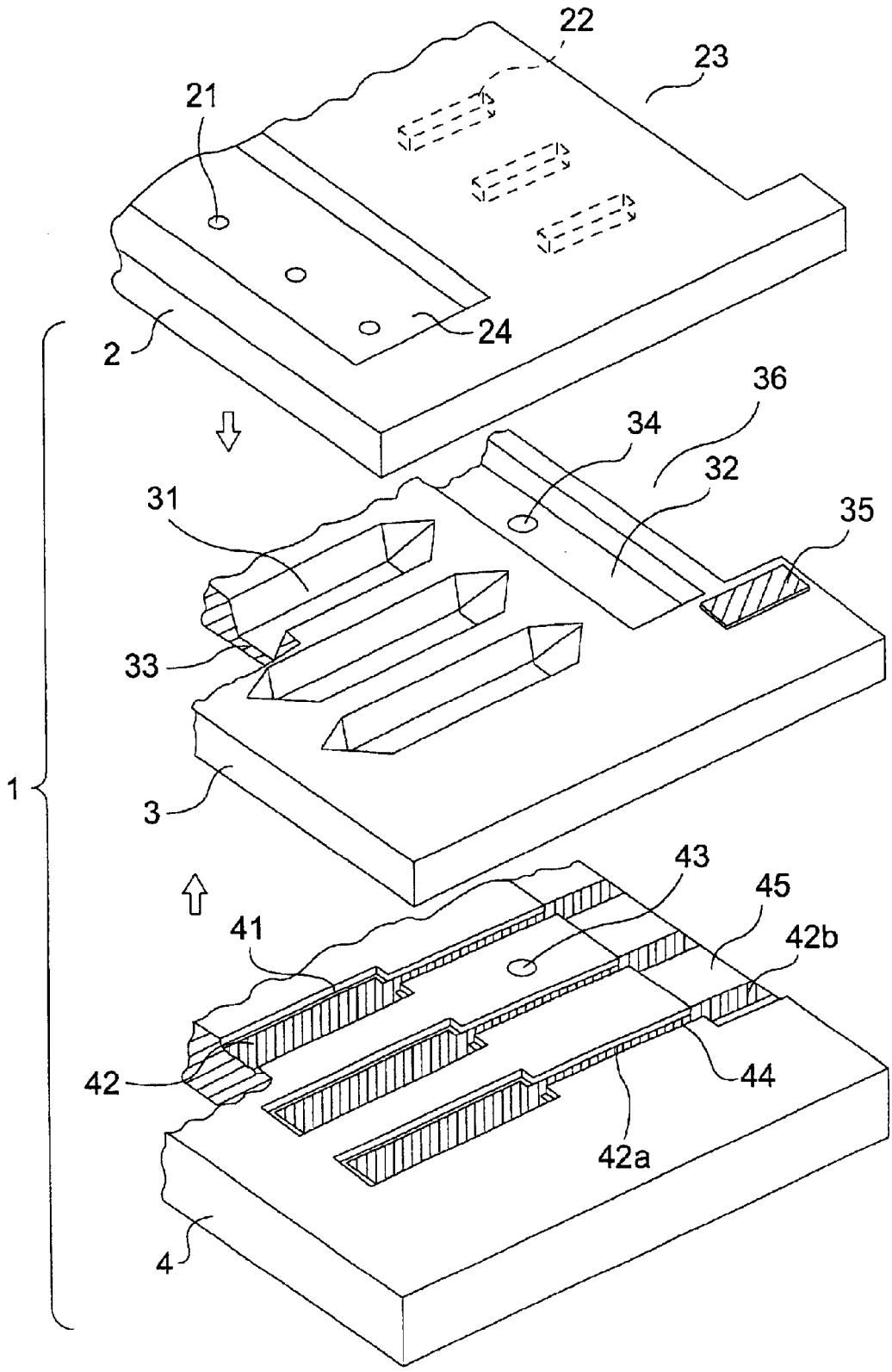
FIG. 1 is an exploded perspective view showing an example of an electrostatic drive type inkjet head to which a method of the present invention can be applied.
Figure 2:
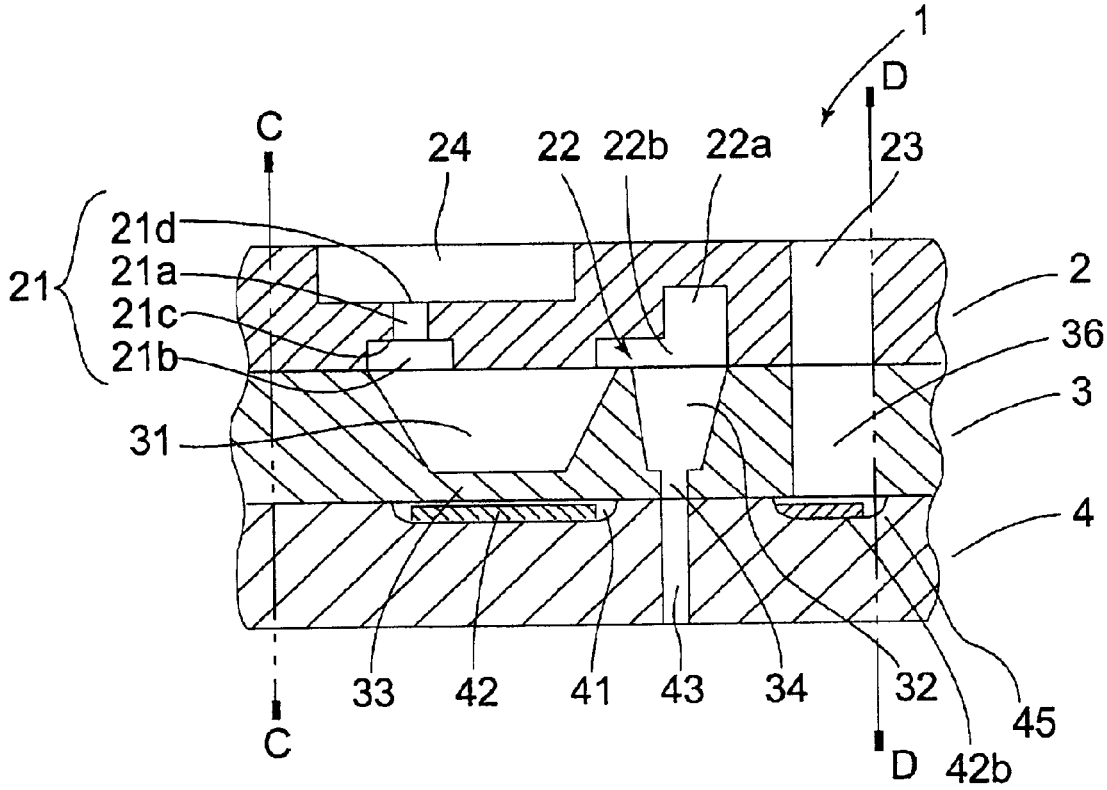
FIG. 2 is a schematic sectional view of the inkjet head shown in FIG. 1.
Figure 3:
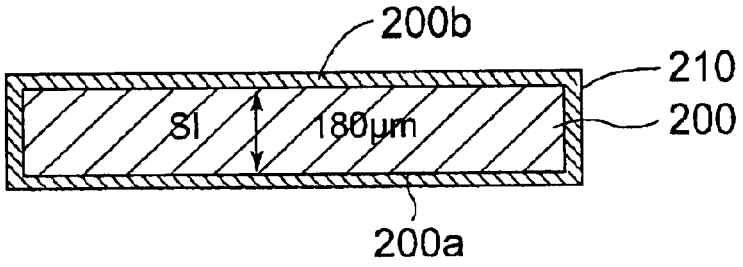
In FIG. 3(A) is an explanatory view showing a first thermally-oxidized-film forming process in a manufacturing process of a nozzle plate for the inkjet head in FIG. 1, (B) is an explanatory view showing a first patterning process of a $SiO_2$ film in the manufacturing process, and (C) is an explanatory view showing a second patterning process of the $SiO_2$ film in the manufacturing process.
Figure 3:
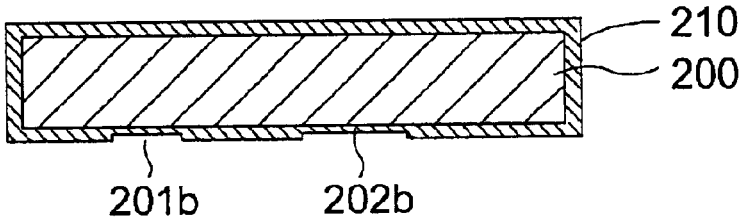
Figure 3:
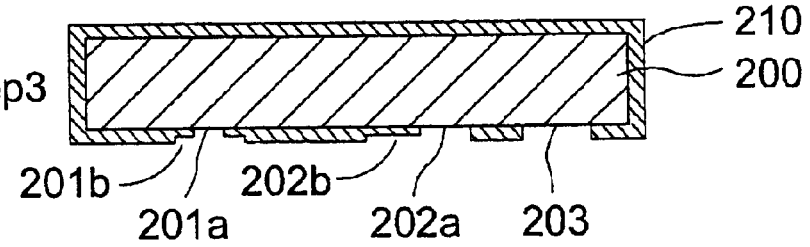

FIG. 1 is an exploded perspective view of an inkjet head to which a method of the present invention can be applied, and FIG. 2 shows a schematic cross-section of the inkjet head in FIG. 1.

Description below is made with reference to FIGS. 1 and 2; the inkjet head 1 of the example is an electrostatic drive type inkjet head similar to the inkjet head disclosed in Japanese Unexamined Patent Publication No. 5-50601, filed by the applicant. The inkjet head 1 is arranged by similarly bonding together a nozzle plate 2 (upper substrate) composed of a silicon monocrystalline substrate, a cavity plate 3 (first lower substrate) composed of a silicon monocrystalline substrate, and a glass substrate 4 (second lower substrate).

Note that while both figures show a single head to simplify description, patterns for a plurality of inkjet heads are formed on each of the substrates 2, 3, and 4. After the substrates are bonded together, they are divided into individual inkjet heads by being cut by dicing along plane C—C and plane D—D shown in FIG. 2.

A plurality of ink cavities 31 and a common ink reservoir 32 for supplying ink to the respective ink cavities 31 are formed on the cavity plate 3. A plurality of nozzles 21 communicating with the respective ink cavities 31 and ink supply ports 22 for communicating the respective ink cavities 31 with the common ink reservoir 32 are formed in the nozzle plate 2. Each ink supply port 22 has a cross-sectional-shape such that a deep groove portion 22*a* is formed at one end thereof and a shallow groove portion 22*b* is formed at the other end thereof.

Recesses 41 are formed on the glass substrate 4, which is bonded to the back surface of the cavity plate 3, at the portions thereof confronting diaphragms 33 which define the bottoms of the ink cavities 31. Individual electrodes 42 are formed on the bottoms of the recesses in confrontation with the diaphragms 33.

The individual electrodes 42 are connected to individual terminals 42*b* disposed in recesses 45 through leads 42*a* disposed in grooves 44.

A through-hole 36 is formed at the cavity plate 3 so that the individual terminals 42*b* are exposed when the cavity plate 3 is bonded to the glass substrate 4. A common terminal 35 is disposed in the vicinity of the through-hole 36 to supply an electrical charge to the diaphragms 33. A through-hole 23 is also formed at the nozzle plate 2 to expose the individual terminals 42*b* and the common terminal 35 when nozzle plate 2 is bonded to the lower substrate. After the bonded substrates are divided into the individual inkjet heads, an FPC (not shown) is connected to these individual terminals 42*b* and 35.

Furthermore, an ink supply hole 34 is formed at the bottom of the ink reservoir 32 and communicates with an ink supply passage 43 formed through the glass substrate 4. Ink can be supplied from an external ink supply source to the ink reservoir 32 through the ink supply passage 43 and the ink supply hole 34.

The diaphragms 33 formed at the cavity plate 3 and regulating the bottoms of the respective ink cavities 31 act as a common electrode. When a voltage is applied across the cavity plate 3 and the individual electrodes 42 confronting the respective diaphragms 33, the diaphragms 33 confronting the individual electrodes 42 on which the voltage is applied are deflected by electrostatic force, whereby the volumes of the cavities 31 are changed and ink droplets are ejected from the nozzles 21.

The nozzle 21 is a nozzle having a stepwise cross-section. That is, a small cross-sectional circular nozzle portion 21*a* (portion on a small cross-sectional side) is formed on the front side of the nozzle 21 in an ink droplet ejecting direction and a large cross-sectional circular nozzle portion 21*b* (portion on a large cross-sectional side) is formed on the rear side thereof, also in that direction. Furthermore, a boundary portion therebetween is arranged as an annular stepped surface 21*c*. Therefore, the cross-sectional shape of the nozzle 21 is made smaller stepwise toward the front end thereof when taken along the axial line thereof Furthermore, the opening 21*d* of the nozzle 21 at the front end thereof is opened to the bottom of a recess 24 formed at the opposite surface of the nozzle plate 2.

Embodiment of Method of Manufacturing Nozzle Plate

FIG. 3–FIG. 6 show an example of a process for manufacturing the nozzle plate 2. A procedure for manufacturing the nozzle plate 2 will be described with reference to these figures.

Step 1: First Thermally-oxidized-film Forming Process

First, as shown in FIG. 3(A), a silicon wafer 200 having a thickness of 180 microns is prepared and thermally oxidized, and an $SiO_2$ film 210 having a thickness of at least 1.2 microns is formed on a surface thereof as a resist film.

Step 2: First Patterning Process of the $SiO_2$ Film

Next, as shown in FIG. 3(B), the $SiO_2$ film 210 covering the surface 200*a* of the silicon wafer 200 is half-etched and a pattern 201*b* and a pattern 202*b* are formed so as to form the large cross-sectional nozzle portion 21*b* of the nozzle 21 and the shallow groove portion 22*b* of the ink supply port 22. Ammonium fluoride (HF:NH4F=880 ml:5610 ml) may be used as an etchant. Furthermore, the etching depth can be set to, for example, 0.5 micron.

Step 3: Second Patterning Process of the $SiO_2$ Film

Thereafter, as shown in FIG. 3(C), patterns 201*a* and 202*a* for forming the small cross-sectional nozzle portion 21*a* of the nozzle 21 and the deep groove portion 22*a* of the ink supply port 22 are formed at the portions of the patterns 201*b* and 202*b* as the half-etched regions of the $SiO_2$ film 210. That is, these half-etched regions are fully etched to thereby form the patterns 201*a* and 202*a* where the surface of the silicon wafer is exposed. A pattern 203 for forming the electrode through-hole 23 is also formed by full-etching the $SiO_2$ film 210 together with the above patterns. Ammonium fluoride, similar to that used above, can be also used as an etchant at this time.

A resist film of a light-sensitive resin is used as a resist film for partially etching the $SiO_2$ film. The resist film is half-solidified when it is coated and then heated, and then it is completely solidified when it is further heated after it is exposed and developed. Thereafter, the $SiO_2$ film is etched as described above, whereby the resist film for etching the silicon is formed.

Step 4: First Dry-etching Process

After the patterning is applied to the $SiO_2$ film 210 twice, anisotropic-dry-etching is applied to the silicon wafer 200 by plasma discharge as shown in FIG. 4(A). With this processing, the surface of the silicon wafer 200 is vertically etched in shapes corresponding to the patterns 201*b*, 202*b*, and 203 formed at step 3, whereby grooves 221, 222, and 223, having the same depth, are formed, respectively. At this time, a carbon fluoride (CF) gas and sulfur hexafluoride ($SF_6$) can be alternately used as an etching gas. The CF gas is used to protect the sides of the grooves so that the etching does not advance thereto and the $SF_6$ is used to promote the etching in the vertical direction of the silicon wafer.

Figure 4B:
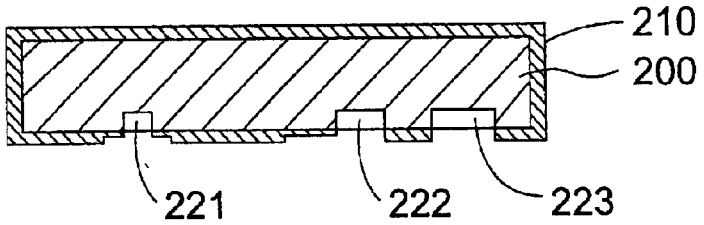
In FIG. 4(A) is an explanatory view showing a first dry-etching process applied to a silicon wafer in the manufacturing process of the nozzle plate for the inkjet head in FIG. 1, (B) is an explanatory view showing a state after a half-etched-portion is removed in the manufacturing process, (C) is an explanatory view showing a second dry-etching process applied to the silicon wafer in the manufacturing process, and (D) is an explanatory view showing a state after the $SiO_2$ film is removed in the manufacturing process.

After the grooves 221, 222, and 223, each having an etching depth of, for example, 35 microns, are formed as described above, the $SiO_2$ film 210 is removed in a thickness of 0.7 micron by etching with a hydrofluoric acid aqueous solution. As a result, the portions of the patterns 201*b* and 202*b* formed at step 2 are completely removed as shown in FIG. 4(B) so that the surface of the silicon wafer 200 is exposed.

Step 5: Second Dry-etching Process

Next, anisotropic-dry-etching is performed again by plasma discharge as shown in FIG. 4(C). As a result, the surface portions of the silicon wafer exposed from the patterns 201*b*, 202*b*, and 203 are vertically etched in a thickness direction while maintaining the cross-sectional shapes thereof. Etching gases used at this time are the same as those used at step 4, and an etching depth is set to, for example, 55 microns. As a result, a nozzle groove 231 having a cross-sectional shape corresponding to the stepwise nozzle 21 and a groove 232 having a cross-sectional shape corresponding to the ink supply port 22 are formed. In addition, a groove 233 having a depth half that of the electrode disposing through-hole 23 is also formed.

Figure 4D:
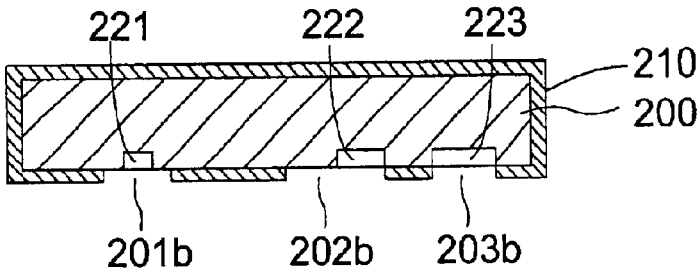
Figure 4D:
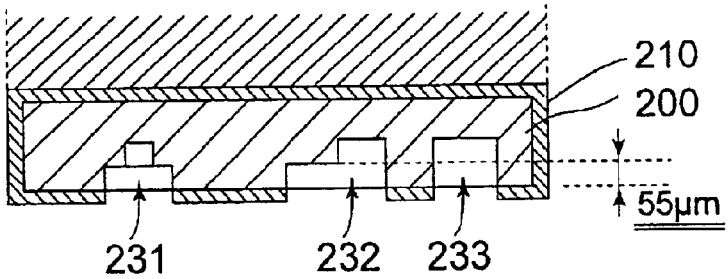
Figure 4:
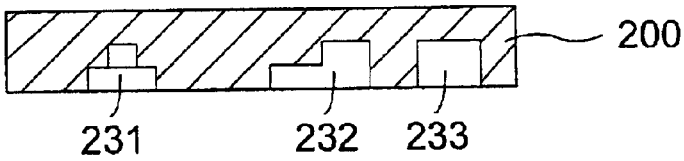

Thereafter, the $SiO_2$ film 210 is entirely removed with a hydrofluoric acid aqueous solution (for example, HF:$H_2O$= 1:5 vol, at 25° C.). FIG. 4(D) shows this state.

Step 6: Second Thermally-oxidized-film Forming Process

Subsequently, the surface of the silicon wafer 200 is again thermally oxidized, thereby forming an $SiO_2$ film 240 as a resist film. It is sufficient to set the thickness of the $SiO_2$ film 240 to 1.2 microns in this case also.

Step 7: Third Patterning Process of the $SiO_2$ Film

Next, the portion of the $SiO_2$ film 240 covering the surface of the silicon wafer 200 opposite to that processed before is etched as shown in FIG. 5(B) to thereby form a pattern 204 corresponding to the recess 24 where the nozzle 21 is opened and a pattern 203A corresponding to the through-hole 23. The etchant used at step 2 can be also used at this time.

Step 8: Wet-etching Process

Figure 5D:
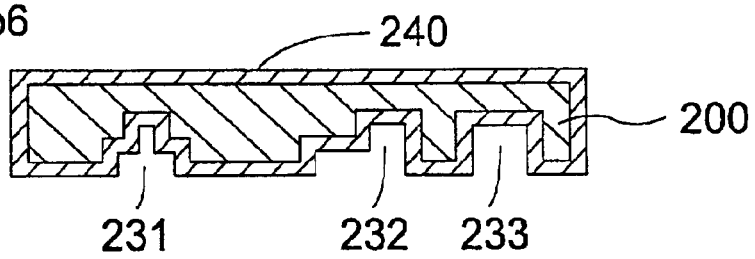
In FIG. 5(A) is an explanatory view showing a second thermally-oxidized-film forming process in the manufacturing process of the nozzle plate for the inkjet head in FIG. 1, (B) is an explanatory view showing a third patterning process of the $SiO_2$ film in the manufacturing process, (C) is an explanatory view showing a wet-etching process applied to the silicon wafer in the manufacturing process, and (D) is an explanatory view showing a state after the $SiO_2$ film is removed in the manufacturing process.
Figure 5D:
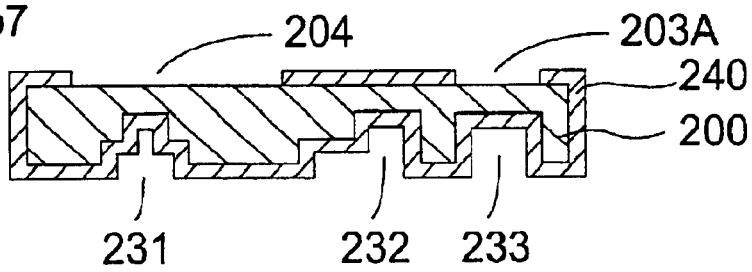
Figure 5D:
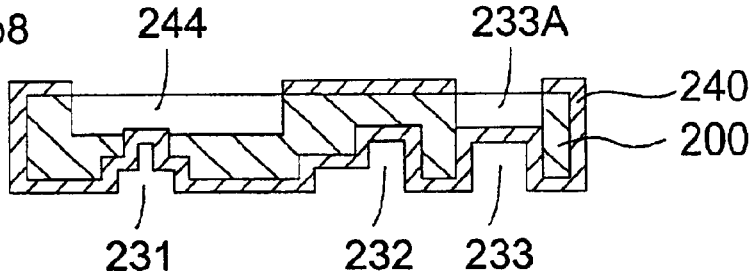
Figure 5:
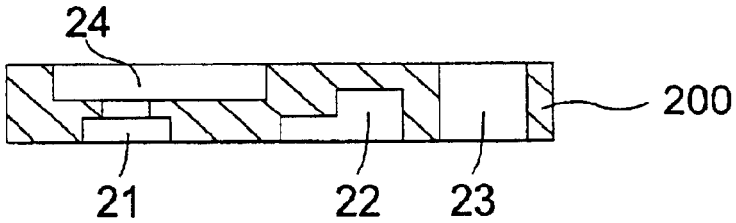
Figure 6:
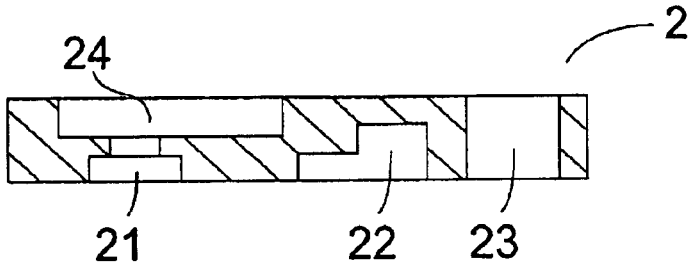
FIG. 6 is an explanatory view showing a final thermally-oxidized-film forming process in the manufacturing process of the nozzle plate for the inkjet head in FIG. 1.
Figure 7:
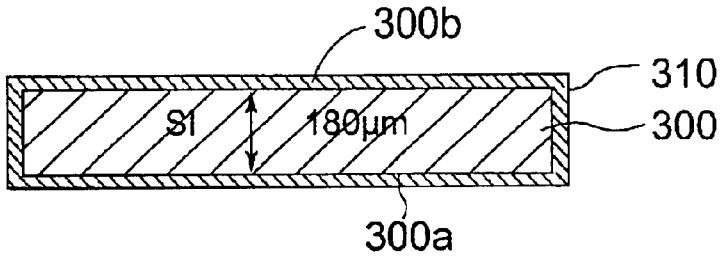
In FIG. 7(A) is an explanatory view showing a first thermally-oxidized-film forming process in the manufacturing process of another embodiment of the nozzle plate for the inkjet head in FIG. 1, (B) is an explanatory view showing a first patterning process of a $SiO_2$ film in the manufacturing process, and (C) is an explanatory view showing a second patterning process of the $SiO_2$ film in the manufacturing process.
Figure 7:
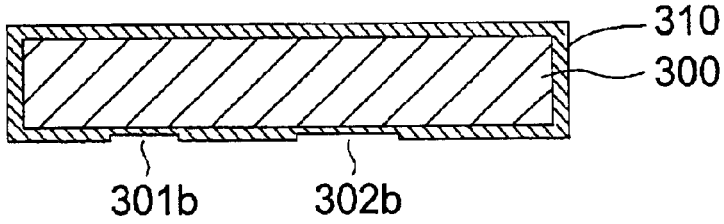
Figure 7:
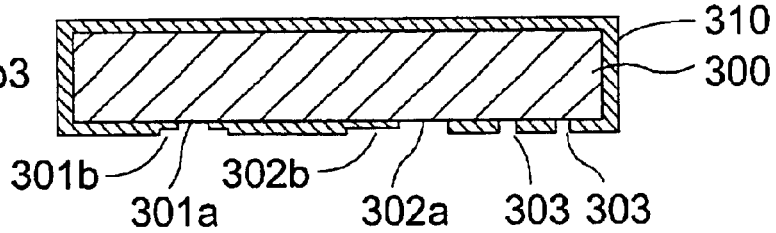

Next, as shown in FIG. 5(C), anisotropic wet-etching is performed on the exposed portion of the silicon wafer 200 by dipping it into an etchant to form a groove 244 corresponding to the recess 24. Furthermore, a groove 233A corresponding to the through-hole 23 is formed. An etchant used at this time is a potassium hydroxide aqueous solution having a concentration of 2 wt % and a liquid temperature of 80° C. The etching depth is set to, for example, 110 microns. After completion of the etching, the $SiO_2$ film 240 is completely removed with a hydrofluoric acid aqueous solution, as shown in FIG. 5(D), so that the grooves 231 and 244, and the grooves 233 and 233A become connected respectively.

Step 9: Final Thermally-oxidizing-process

Finally, the silicon wafer is again thermally oxidized and an $SiO_2$ film is formed in order to secure the ink resistant property of the silicon wafer and the intimate contact property of a nozzle surface achieved by water repelling processing. The nozzle plate 2 can be obtained by the above procedure.

Another Embodiment of Method of Manufacturing a Nozzle Plate

In the above embodiment, etching is conducted on one surface side of the silicon wafer 200 for forming the nozzle plate 2 so that the fine groove 231 for the nozzle 21, and the groove 223 for the electrode wiring through-hole 23, are formed. Furthermore, the grooves 244 and 233A, which are larger than the groove of the nozzle 21, are formed from the other surface side of the silicon wafer 200 so that the nozzle groove 231 connects the groove 244 to thereby form the nozzle 21, and the groove 233 connects the groove 233A to thereby obtain the through-hole 23 at the same time.

When the etched area of the through-hole 23 is made very large in the dry-etching processes at steps 4 and 5 at the time the nozzle and the through-hole are formed by the above method, etching speed will be reduced and variation of etching depths will be greatly increased at the surface of the wafer. However, these problems can be solved by the method described below.

FIG. 7–FIG. 10 show the manufacturing process of the nozzle plate 2 of another embodiment of the present invention. The manufacturing procedure of the nozzle plate 2 will be described with reference to these figures. In the following description, the description of the points overlapping with the above embodiment will be omitted.

Step 1–step 3

A first thermally-oxidized-film forming process is carried out in step 1 and a first patterning process for a $SiO_2$ film is carried out in step 2 in manners similar to those in the above embodiment. A second patterning process for the $SiO_2$ film is carried out in step 3 thereafter in manner similar to that in the above embodiment. However, a pattern 303 for forming an electrode through-hole 23 is formed in the $SiO_2$ film 310 by full-etching it into a ring groove shape so that the contour of the outer periphery of the through-hole 23 is drawn. Note that ammonium fluoride, similar to that above, can be used as an etchant at this time.

Step 4–step 5

Figure 8B:
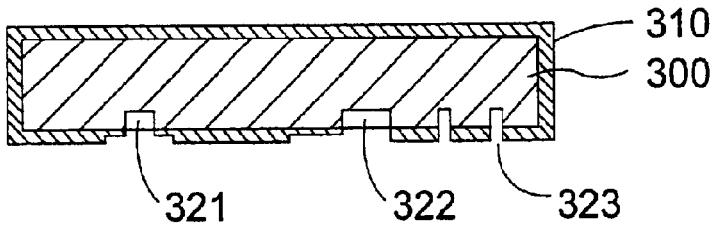
In FIG. 8(A) is an explanatory view showing a first dry-etching process applied to a silicon wafer in the manufacturing process of another embodiment of the nozzle plate for the inkjet head in FIG. 1, (B) is an explanatory view showing a state after a half-etched portion is removed in the manufacturing process, (C) is an explanatory view showing a second dry-etching process applied to the silicon wafer in the manufacturing process, and (D) is an explanatory view showing a state after the $SiO_2$ film is removed in the manufacturing process.
Figure 8D:
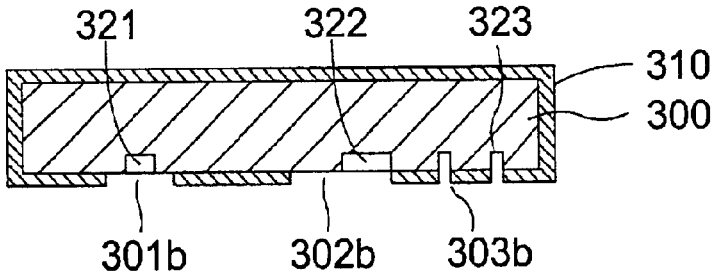
Figure 8D:
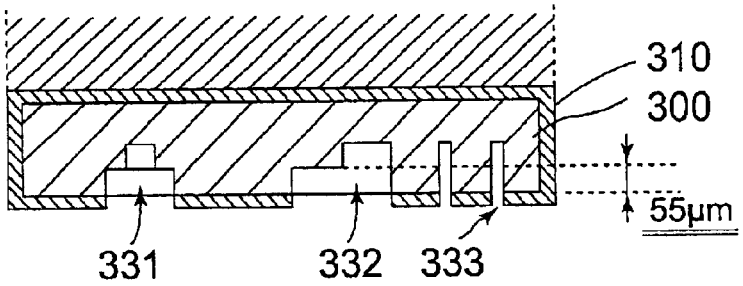
Figure 8:
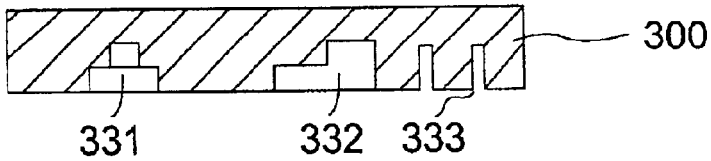
Figure 9D:
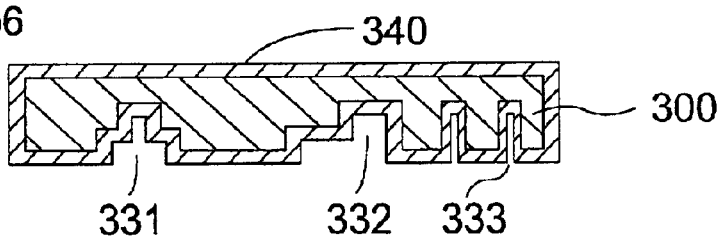
In FIG. 9(A) is an explanatory view showing a second thermally-oxidized-film forming process in the manufacturing process of the another embodiment of the nozzle plate for the inkjet head in FIG. 1, (B) is an explanatory view showing a third patterning process of the $SiO_2$ film in the manufacturing process, (C) is an explanatory view showing a wet-etching process applied to the silicon wafer in the manufacturing process, and (D) an explanatory view showing a state after the $SiO_2$ film is removed in the manufacturing process.
Figure 9D:
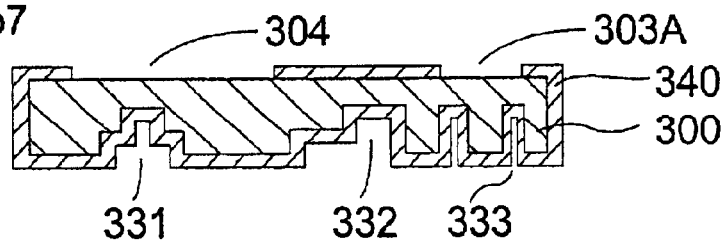
Figure 9D:
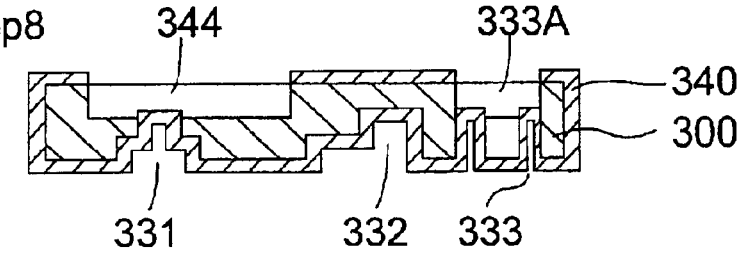
Figure 9:
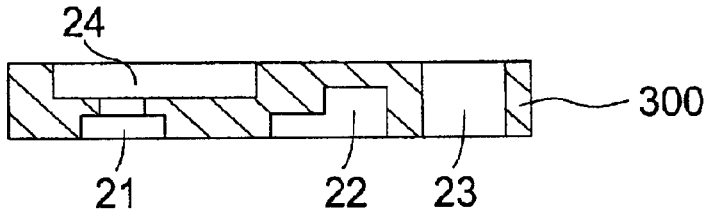

After the patterning is conducted on the $SiO_2$ film 310 as described above, anisotropic-dry-etching is applied to a silicon wafer 300 by plasma discharge, for example, by ICP discharge as shown in FIG. 8(A) in manner similar to the above embodiment.

With this processing, in step 4, one surface side of the silicon wafer 300 is vertically etched in the shapes corresponding to patterns 301*b*, 302*b*, and 303 formed in step 3, whereby grooves 321, 322, and 323 having the same depth are formed, respectively.

Thereafter, the $SiO_2$ film 310 is completely removed at the portions of the patterns 301*b* and 302*b* with a hydrofluoric acid aqueous solution and anisotropic-dry-etching is carried out again by plasma discharge, for example, by ICP discharge as shown in FIG. 8(C). As a result, the surface portions of the silicon wafer exposed from the patterns 301*b*, 302*b*, and 303 are vertically etched in a thickness direction while maintaining the cross-sectional shapes thereof.

In each of the dry-etching processes performed twice in step 4 and step 5, the groove 323 is only the outer peripheral groove for forming the through-hole. Thus, the etching area can be greatly reduced and etching speed can be increased, and the variation of the etching depths in the surface of the wafer can be avoided.

Figure 10:
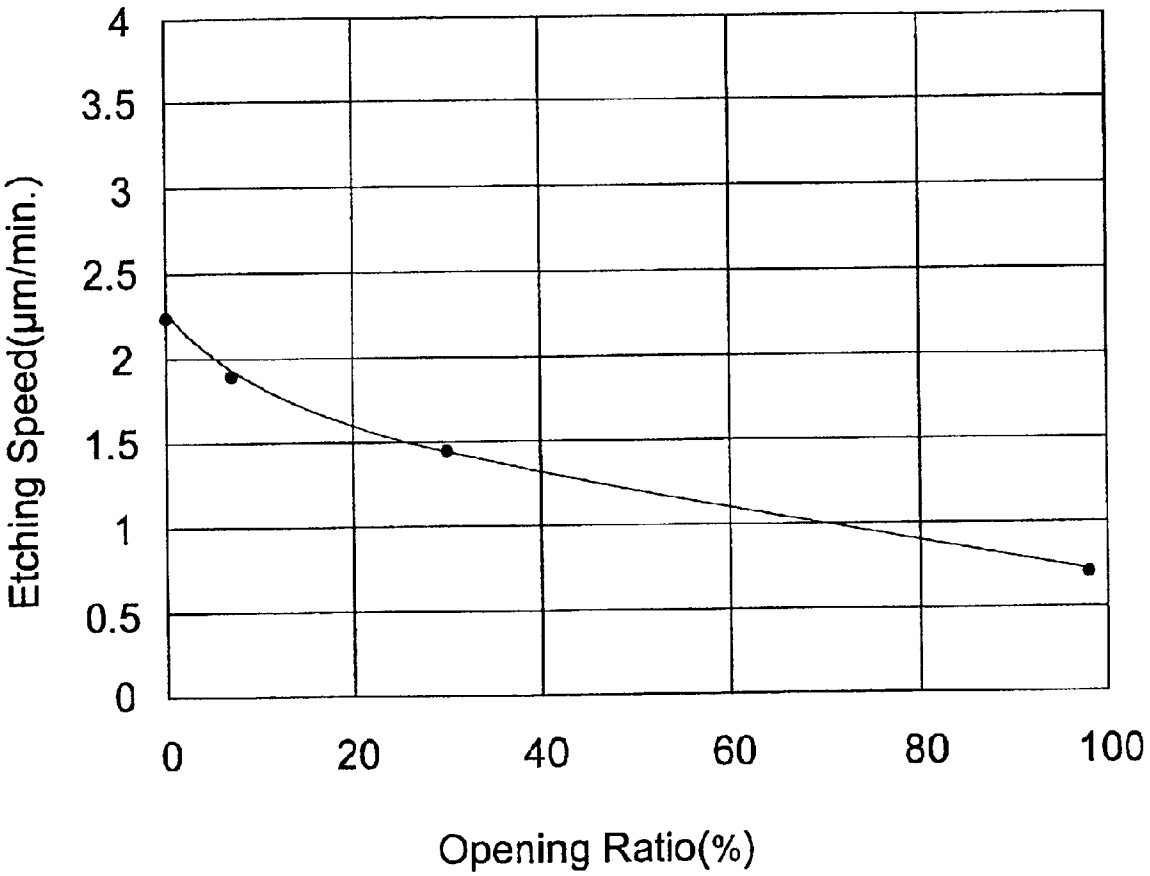
FIG. 10 is a graph showing the relationship between the aperture ratio of a silicon wafer and an etching speed in the dry-etching process of a silicon wafer.

FIG. 10 shows an example of the relationship between the etching speed and an opening ratio. The opening ratio described here is the ratio of the area of the etched portions of the wafer to the area of the wafer. When the opening ratio is, for example, 30%, the etching speed is 1.4 $\mu$m/min, and when the opening ratio is, for example, 7%, the etching speed is 1.9 $\mu$m/min, as shown in FIG. 10. That is, when the opening ratio is reduced from 30% to 7%, the etching speed increases about 36%. Furthermore, regarding the variation of the depths in the wafer surface, when the opening ratio is 30%, the uniformity in the wafer surface is 6%, whereas when the opening ratio is 7%, the uniformity in the wafer surface is greatly improved to 4%.

Thereafter, a second thermally-oxidized-film forming process (step 6), a third patterning-process for the $SiO_2$ film (step 7), a wet-etching process (step 8) and a final thermally-oxidizing-process (step 9) are carried out in manners similar to those of the above embodiment, whereby the nozzle plate is completed. Note that in step 8, a groove 333A formed by anisotropic-wet-etching penetrates to groove 333 formed in step 5, whereby the silicon of the portion surrounded by the groove 333 is removed from the silicon wafer 300 so as to form the through-hole 23.

Other Embodiments

As other anisotropic-dry-etching methods, ECR (electron cyclotron resonance) discharge, HWP (helicon wave plasma) discharge, RIE (reactive ion etching) and the like may be used.

Furthermore, while the inkjet head used for an inkjet printer has been described in the above embodiments, the present invention is not limited thereto, and it is effective to apply the nozzle forming method of the present invention to the nozzle of an ejection device provided with a nozzle for spraying a liquid or a gas. For example, the present invention may be applied to form the nozzle of a fuel injection device of an engine.

What is claimed is:

1. An ejection device comprising:

a nozzle plate comprising a silicon substrate having a first surface and a second surface;

a plurality of first nozzle portions each having a circular cross-section, each of the first nozzle portions formed in the silicon substrate;

a plurality of second nozzle portions each having a circular cross-section, each of the second nozzle portions formed on the second surface of the silicon substrate, and communicating with a corresponding first nozzle portion, the circular cross-section of each of the first nozzle portions being smaller than the circular cross-section of each of the second nozzle portions, the first and second nozzle portions forming nozzles each having a cross-section smaller stepwise from a rear end toward a front end of each nozzle; and a recess formed on the first surface of the silicon substrate, the recess having a flat bottom surface commonly communicating with the plurality of first nozzle portions such that the front end of each of the nozzles is exposed to the recess; and wherein the plurality of first and second nozzle portions are formed by applying dry-etching by plasma discharge to the second surface of the silicon substrate, and the recess is formed by applying wet-anisotropic-etching to the first surface of the silicon substrate.

2. An ejection device according to claim 1, wherein the plurality of first and second nozzle portions are formed by patterning a stepwise exposed portion on a resist film formed on the second surface of the silicon substrate and applying dry-etching by plasma discharge to the stepwise exposed portion.

3. An inkjet head comprising:

a nozzle plate comprising a silicon substrate having a first surface and a second surface;

a plurality of first nozzle portions each having a circular cross-section, each of the first nozzle portions formed in the silicon substrate;

a plurality of second nozzle portions each having a circular cross-section, each of the second nozzle portions formed on the second surface of the silicon substrate, and communicating with a corresponding first nozzle portion, the circular cross-section of each of the first nozzle portions being smaller than the circular cross-section of each of the second nozzle portions, the first and second nozzle portions forming nozzles each having a cross-section smaller stepwise from a rear end toward a front end of each nozzle;

a recess formed on the first surface of the silicon substrate, the recess having a flat bottom surface commonly communicating with the plurality of first nozzle portions such that the front end of each of the nozzles is exposed to the recess; and a second substrate including ink passages, the second substrate being bonded to the second surface of the silicon substrate such that each ink passage communicates with a rear end of a corresponding one of the nozzles; and wherein the first nozzle portions and the second nozzle portions are formed by applying dry-etching by plasma discharge to the second surface of the silicon substrate, and the recess is formed by applying wet-anisotropic-etching to the first surface of the silicon substrate.

4. An inkjet head according to claim 3, wherein the first and second nozzle portions are formed by patterning a stepwise exposed portion on a resist film formed on the second surface of the silicon substrate and applying dry-etching by plasma discharge to the stepwise exposed portion.

5. An inkjet head according to claim 3, further comprising:

a plurality of pressure generators each corresponding to an ink passage;

a plurality of terminal portions that each supply a control signal to a corresponding pressure generator; and a through-hole formed in the silicon substrate that exposes the terminal portions.

* * * * *